US009608361B2

(12) United States Patent
Vaccaro

(10) Patent No.: US 9,608,361 B2
(45) Date of Patent: Mar. 28, 2017

(54) PROTECTIVE SLEEVE FOR WEATHERPROOFING BOOT FOR INTERFACE OF CABLE TO REMOTE RADIO HEAD

(71) Applicant: CommScope Technologies LLC, Hickory, NC (US)

(72) Inventor: Ronald A. Vaccaro, Shorewood, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/205,984

(22) Filed: Jul. 8, 2016

(65) Prior Publication Data

US 2017/0018871 A1 Jan. 19, 2017

Related U.S. Application Data

(60) Provisional application No. 62/192,311, filed on Jul. 14, 2015.

(51) Int. Cl.

| | |
|---|---|
| ***H01R 13/52*** | (2006.01) |
| ***H01R 13/46*** | (2006.01) |
| ***H01R 24/38*** | (2011.01) |
| *H01R 103/00* | (2006.01) |

(52) U.S. Cl.

CPC ..... *H01R 13/5205* (2013.01); *H01R 13/5213* (2013.01); *H01R 24/38* (2013.01); *H01R 2103/00* (2013.01)

(58) Field of Classification Search

CPC ..... H01R 13/5221; H01R 13/5206; H01R 13/5213; B60L 11/1818; B60L 11/1816

See application file for complete search history.

(56) References Cited

U.S. PATENT DOCUMENTS

| | | | | | |
|---|---|---|---|---|---|
| 3,183,302 | A * | 5/1965 | Wochner | H01R 4/20 | 174/138 F |
| 3,417,359 | A * | 12/1968 | Urani | H01H 85/201 | 337/201 |
| 3,567,843 | A * | 3/1971 | Collins | H02G 3/0616 | 174/51 |
| 4,643,505 | A * | 2/1987 | House | H01R 13/6392 | 174/92 |
| 5,015,013 | A * | 5/1991 | Nadin | F16L 25/0045 | 285/419 |
| 5,315,062 | A * | 5/1994 | Hoshino | H01R 13/506 | 174/72 C |
| 5,525,073 | A * | 6/1996 | Sampson | H02G 15/18 | 439/358 |

(Continued)

*Primary Examiner* — Briggitte R Hammond

(74) *Attorney, Agent, or Firm* — Myers Bigel, P.A.

(57) ABSTRACT

An assembly includes: a cable; a first connector attached to the cable; a second connector that mates with the first connector to form an interface; a sealing boot that encloses the interface, the sealing boot including a cable section that fits conformably over the cable; a conduit that circumferentially overlies a portion of the cable adjacent the first connector, the conduit including a plurality of first corrugations; and a protective cover that overlies the corrugations of the conduit and the sealing boot, the cover including at least one second corrugation on an inner surface thereof that interdigitates with one of the first corrugations.

20 Claims, 2 Drawing Sheets

(56) References Cited

U.S. PATENT DOCUMENTS 5,627,343 A * 5/1997 Brandolf ..... H02G 3/22 156/86
5,886,294 A * 3/1999 Scrimpshire ..... G02B 6/3887 174/359
5,888,097 A * 3/1999 DiCicco ..... H01R 9/032 439/589
6,007,378 A * 12/1999 Oeth ..... H01R 13/5213 439/279
6,109,945 A * 8/2000 Creelle ..... H01R 13/5219 439/278
6,126,477 A * 10/2000 Smith ..... H01R 13/6592 439/447
6,254,418 B1 * 7/2001 Tharp ..... H01R 13/6335 439/352
6,359,228 B1 * 3/2002 Strause ..... G02B 6/4446 174/41
6,955,558 B1 * 10/2005 Low ..... H02G 15/013 439/467
7,081,003 B1 * 7/2006 Gregori ..... H01R 13/516 439/352
7,240,930 B2 * 7/2007 Stravitz ..... D06F 58/20 285/148.26
7,388,149 B2 * 6/2008 Doherty ..... F16L 25/0045 174/21 JS
7,431,614 B2 * 10/2008 Eriksen ..... H01R 13/5825 439/578
7,581,564 B2 * 9/2009 Tanaka ..... F16L 21/06 138/110
7,736,181 B1 * 6/2010 Benevento ..... H01R 9/0518 439/585
7,767,908 B2 * 8/2010 Sylvan ..... F16L 5/10 174/72 A
7,942,694 B2 * 5/2011 Amidon ..... H01R 9/05 439/279
8,108,968 B2 * 2/2012 Pietryga ..... H02G 3/0468 16/2.1
D680,081 S * 4/2013 Yamauchi ..... D13/156
8,444,325 B2 * 5/2013 Guest ..... G02B 6/4439 385/53
8,517,768 B2 * 8/2013 Blaha ..... H01H 85/0026 337/195
8,764,480 B2 * 7/2014 Natoli ..... H01R 13/5213 439/523
9,425,604 B1 * 8/2016 Lawrence ..... H02G 15/007
9,531,180 B2 * 12/2016 Xu ..... H02G 15/013
2004/0154817 A1 * 8/2004 Sudo ..... H02G 3/06 174/481
2004/0245730 A1 * 12/2004 Holland ..... F16L 37/138 277/602
2010/0092137 A1 * 4/2010 Niiyama ..... G02B 6/3807 385/78
2010/0248533 A1 * 9/2010 Montena ..... H01R 13/5213 439/521
2011/0287667 A1 * 11/2011 Ichio ..... H01R 13/4367 439/660
2012/0149227 A1 * 6/2012 Yoshida ..... H01R 13/5202 439/277
2014/0057472 A1 * 2/2014 Xu ..... H01R 13/5205 439/275
2014/0057473 A1 * 2/2014 Xu ..... H01R 13/5202 439/275
2014/0097022 A1 * 4/2014 Vaccaro ..... B29C 45/261 174/77 R
2014/0295703 A1 * 10/2014 Nagashima ..... H02J 5/005 439/607.01
2015/0136439 A1 5/2015 Vaccaro

* cited by examiner

PROTECTIVE SLEEVE FOR WEATHERPROOFING BOOT FOR INTERFACE OF CABLE TO REMOTE RADIO HEAD

RELATED APPLICATION

The present application claims priority from and the benefit of U.S. Provisional Patent Application No. 62/192,311, filed Jul. 14, 2015, the disclosure of which is hereby incorporated herein by reference in its entirety.

FIELD OF THE INVENTION

The present invention relates generally to protection of electronic equipment, and more particularly to protection of the transition area from cable to a remote radio unit (RRU), antenna or the like.

BACKGROUND

Cables are typically attached to electronic equipment such as RRUs and antennas via mating connectors, one of which terminates the cable, and the other of which is mounted on the electronic equipment. The interface between the connectors can be vulnerable to precipitation and other environmental conditions. As such, in many instances a protective cover or boot may enclose the interface to protect it. Exemplary boots are discussed in U.S. Patent Publication No. 2015/0136439, filed Apr. 4, 2014, the disclosure of which is hereby incorporated herein in its entirety.

In the design of a cable assembly it is often required that the separated cables be protected from certain birds, in particular cockatoos, that tend to damage the cables through unwanted pecking. To "bird-proof" the cables, a protective conduit is typically used. The protective conduit is generally greater than 19 mm in diameter to prevent the birds from pecking at and damaging the cables. However, the covers or boots may still be susceptible to damage from birds.

SUMMARY

As a first aspect, embodiments of the invention are directed to an assembly, comprising: a cable; a first connector attached to the cable; a second connector that mates with the first connector to form an interface; a sealing boot that encloses the interface, the sealing boot including a cable section that fits conformably over the cable; a conduit that circumferentially overlies a portion of the cable adjacent the first connector, the conduit including a plurality of first corrugations; and a protective cover that overlies the corrugations of the conduit and the sealing boot, the cover including at least one second corrugation on an inner surface thereof that interdigitates with one of the first corrugations.

As a second aspect, embodiments of the invention are directed to a protective cover for a sealing boot of a coaxial connector interface, comprising two mating halves, each of the halves including a coupler section at one end, an intermediate section that merges with and is smaller in diameter than the coupler section, and a conduit section that merges and is smaller in diameter than the intermediate section, wherein the conduit section has an inner surface with a corrugated profile.

As a third aspect, embodiments of the invention are directed to an assembly, comprising: a cable; a first connector attached to the cable; a second connector that mates with the first connector to form an interface; a protective barrier that encloses the interface, the protective barrier including a cable section that fits conformably over the cable; a conduit that circumferentially overlies a portion of the cable adjacent the first connector, the conduit including a plurality of first corrugations; and a protective cover that overlies the corrugations of the conduit and the protective barrier, the cover including at least one second corrugation on an inner surface thereof that interdigitates with the first corrugations.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
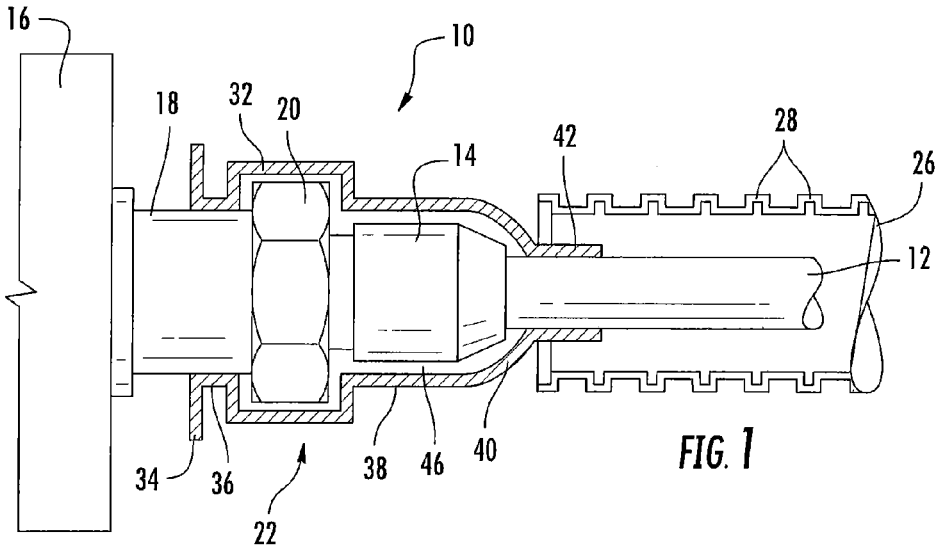
FIG. 1 is a side section view of an interface between a remote radio head and a coaxial cable protected by a sealing boot, with a conduit in place over the coaxial cable.

Referring now to the figures, a cable-equipment interface, designated broadly at 10, is shown in FIG. 1. The interface 10 includes a cable 12 terminated with a connector 14. A piece of electronic equipment 16, such as an RRU or antenna, includes a connector 18 mounted thereon that mates with the connector 14 of the cable 12. In the illustrated embodiment, the connectors 14, 18 are secured with a coupling nut 20.

The interface between the cable 12 and the equipment 16 is protected by a sealing boot 22. As can be seen in FIG. 1, the sealing boot 22 includes a generally cylindrical interconnection section 32. A flange 34 is mounted to the interconnection section 32 via a short trunk 36. A generally cylindrical main section 38 merges with the interconnection section 32 opposite the trunk 36. The main section 38 is smaller in diameter than the interconnection section 32. A tapered transition section 40 merges with the main section 38; in turn, a generally cylindrical cable section 42 merges with the transition section 40. Thus, the hollow, generally coaxial sections of the boot 22 define a continuous bore 46.

The boot 22 may be formed of any number of materials, but is typically formed of an elastomeric material, such as rubber, that can recover to its original shape after significant deformation. The boot 22 is typically formed as a unitary member, and in particular may be formed via transfer, compression or injection molding. Those skilled in this art will recognize that other boot configurations may be suitable.

Still referring to FIG. 1, a conduit 26 is positioned over the cable 12. The conduit includes circumferential corrugations 28. The conduit 26 is formed of a material such as nylon that is sufficiently hardy to resist damage from birds. The conduit 26 in the illustrated embodiment is 19 mm in diameter, but may be sized differently (e.g., larger than 19 mm) as desired or needed.

As can be seen in FIG. 1, the conduit 26 does not protect the boot 22 from exposure to birds. As such, the boot 22 may be vulnerable to damage from birds.

Figure 2:
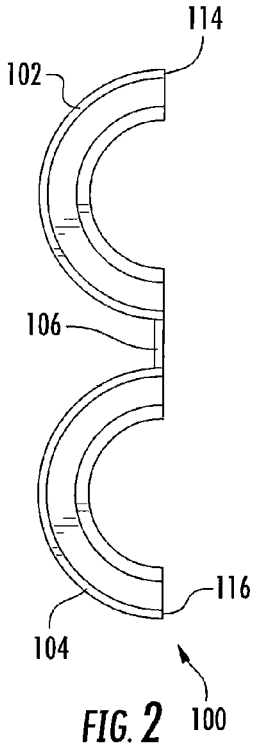
FIG. 2 is an end view of a protective cover for the interface and sealing boot of FIG. 1, with the cover in an unassembled condition.
Figure 3:
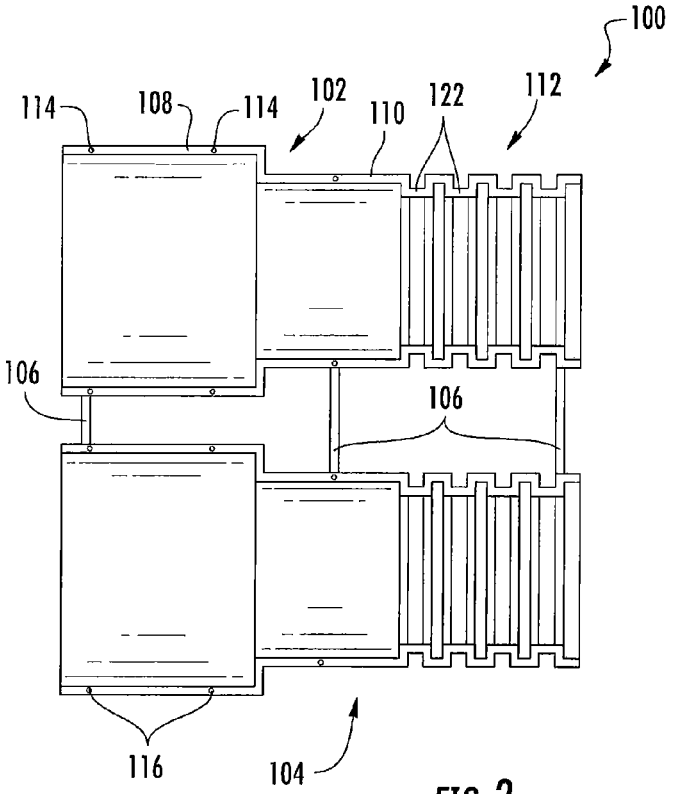
FIG. 3 is a side view of the unassembled protective cover of FIG. 2.

Referring now to FIGS. 2 and 3, a hollow protective cover for the boot 22, designated broadly at 100, is illustrated therein. The cover 100 includes two halves 102, 104 that are connected with three hinge strips 106. Each of the halves 102, 104 has a coupler section 108 at one end, an intermediate section 110 that merges with the coupler section 108, and a conduit section 112 that merges with the intermediate section 110. As can be seen in FIG. 3, the conduit section 112 has corrugations 122 on its inner surface.

The cover 100 may be formed of a number of different materials. The cover 100 may be formed of a polymeric material with sufficient flexibility to enable the hinge strips 106 to serve as "living hinges". Exemplary materials for the cover 100 are nylon and high density polyurethane.

The halves 102, 104 can be mated to form the cover 100. The hinge strips 106 are sufficiently flexible that the edges of the halves 102, 104 can be brought together to mate in facing relationship. Alignment pins 114 are present on the edges of the half 102; corresponding holes 116 are present in the edges of the half 104. When the halves 102, 104 are brought together, the pins 114 are inserted into the holes 116 to secure the halves 102, 104 into a hollow enclosure. Those skilled in this art will appreciate that other securing features (e.g., latches, clips and the like) may be employed to secure the halves 102, 104 together.

Figure 4:
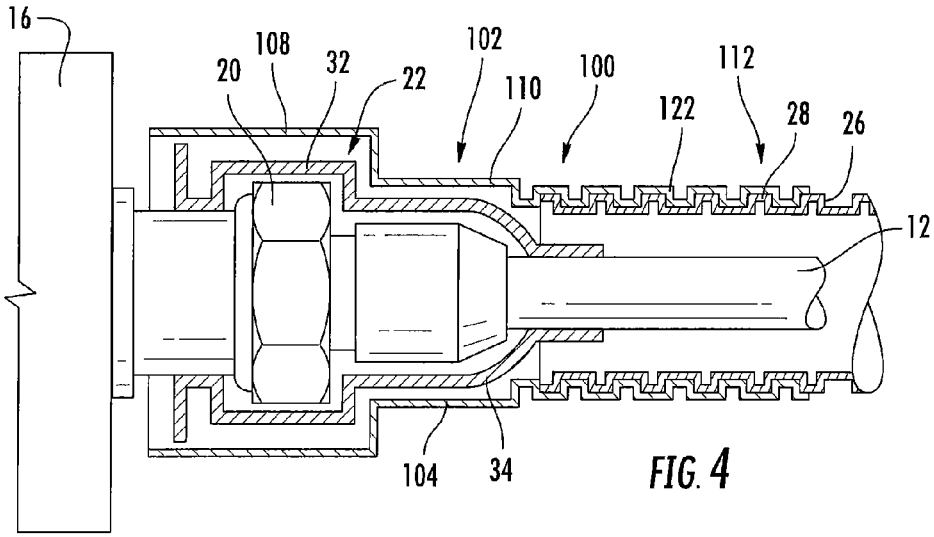
FIG. 4 is a side section view of the interface and sealing boot of FIG. 1 protected within the cover of FIG. 2.

To protect the boot 22, the cover 100 can be mated as described above over the boot 22 and conduit 26 (see FIG. 4). The cover 100 is positioned so that the corrugations 122 of the conduit section 112 are interdigitated with the corrugations 28 of the conduit 26. This interdigitation helps to secure the cover 100 in place over the conduit 26. The intermediate section 110 of the cover 100 overlies the main section 34 of the boot 22. The coupler section 108 overlies the interconnection section 32 of the boot 22. Thus, the cover 100 generally surrounds the boot 22 and protects it from damage due to avian activity.

Those skilled in this art will appreciate that other forms of protective barriers of the cable-equipment interface, such as vinyl and/or butyl mastic tape, may be suitable for use with covers of the present invention.

In addition, those skilled in this art will appreciate that cover 100 may take other forms. For example, the halves 102, 104 may be separate components, rather than being connected via the hinge strips 106, or may be connected to each other by some other means (for example, a wire or string). Also, the halves 102, 104 may be secured to each other via other means, such as adhesive, hook-and-loop strips, screws, or the like. Moreover, the corrugations 122 may be circumferentially discontinuous about the inner diameter of the cover 100, and/or a single corrugation (rather than a plurality) may be present. Other variations will be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An assembly, comprising:

a cable;

a first connector attached to the cable;

a second connector that mates with the first connector to form an interface;

a sealing boot that encloses the interface, the sealing boot including a cable section that fits conformably over the cable;

a conduit that circumferentially overlies a portion of the cable adjacent the first connector, the conduit including a plurality of first corrugations; and a protective cover that overlies the corrugations of the conduit and the sealing boot, the cover including at least one second corrugation on an inner surface thereof that interdigitates with one of the first corrugations.

2. The assembly defined in claim 1, wherein the protective cover comprises a pair of mating halves.

3. The assembly defined in claim 2, wherein the protective cover further comprises at least one hinge strip connected between the two mating halves that serves as a living hinge.

4. The assembly defined in claim 2, further comprising securing features on the mating halves to maintain the mating halves in a mated condition.

5. The assembly defined in claim 1, wherein the protective cover is formed of a polymeric material.

6. The assembly defined in claim 1, wherein the cable is a coaxial cable.

7. The assembly defined in claim 1, wherein the first and second connectors are coaxial connectors assembled with a coupling nut, wherein the sealing boot overlies the coupling nut, and wherein the protective cover overlies the sealing boot.

8. The assembly defined in claim 1, wherein the conduit is at least 19 mm in diameter.

9. The assembly defined in claim 1, wherein the at least one second corrugation is a plurality of second corrugations.

10. A protective cover for a sealing boot of a coaxial connector interface, comprising:

two mating halves, each of the halves including a coupler section at one end, an intermediate section that merges with and is smaller in diameter than the coupler section, and a conduit section that merges and is smaller in diameter than the intermediate section, wherein the conduit section has an inner surface with a corrugated profile.

11. The protective cover defined in claim 10, further comprising at least one hinge strip connected between the two mating halves that serves as a living hinge.

12. The protective cover defined in claim 10 formed of a polymeric material.

13. The protective cover defined in claim 10, further comprising securing features on the mating halves to maintain the mating halves in a mated condition.

14. An assembly, comprising:

a cable;

a first connector attached to the cable;

a second connector that mates with the first connector to form an interface;

a protective barrier that encloses the interface, the protective barrier including a cable section that fits conformably over the cable;

a conduit that circumferentially overlies a portion of the cable adjacent the first connector, the conduit including a plurality of first corrugations; and a protective cover that overlies the corrugations of the conduit and the protective barrier, the cover including at least one second corrugation on an inner surface thereof that interdigitates with the first corrugations.

15. The assembly defined in claim 14, wherein the protective cover comprises a pair of mating halves.

16. The assembly defined in claim 15, wherein the protective cover further comprises at least one hinge strip connected between the two mating halves that serves as a living hinge.

17. The assembly defined in claim 15, further comprising securing features on the mating halves to maintain the mating halves in a mated condition.

18. The assembly defined in claim 14, wherein the first and second connectors are coaxial connectors assembled with a coupling nut, wherein the sealing boot overlies the coupling nut, and wherein the protective cover overlies the sealing boot.

19. The assembly defined in claim 14, wherein the conduit is at least 19 mm in diameter.

20. The assembly defined in claim 14, wherein the at least one second corrugation is a plurality of second corrugations.

* * * * *